United States Patent [19]

Jenkins

[11] Patent Number: 4,757,843

[45] Date of Patent: Jul. 19, 1988

[54] SHUTTLE RETURNER APPARATUS

[75] Inventor: John W. Jenkins, Hampton, Ga.

[73] Assignee: Bellwether, Inc., Atlanta, Ga.

[21] Appl. No.: 25,873

[22] Filed: Mar. 16, 1987

[51] Int. Cl.[4] ..... D03D 47/24

[52] U.S. Cl. ..... 139/439

[58] Field of Search ..... 139/437, 438, 439, 183, 139/185, 252

[56] References Cited

U.S. PATENT DOCUMENTS 596,315 12/1897 Bannister .
2,527,066 10/1950 Kennedy .
3,875,974 4/1975 Rambousek .
4,415,010 11/1983 Schmitz .

*Primary Examiner*—Henry S. Jaudon
*Attorney, Agent, or Firm*—Jones, Askew & Lunsford

[57] ABSTRACT

An improved shuttle returner for use in projectile looms. The shuttle returner comprises a relatively inelastic member for receiving the impact of an arriving shuttle, and a relatively elastic member coupled to the receiving member for absorbing the shuttle impact. The receiving member and elastic body member are joined together along mutually confronting surfaces substantially perpendicular to the line of impact, maximizing transfer of force into the body member without transmitting substantial impact through the elements interconnecting the receiving member and body member.

5 Claims, 1 Drawing Sheet

SHUTTLE RETURNER APPARATUS

FIELD OF THE INVENTION

This invention relates in general to projectile looms, and in particular relates to a shuttle for use in a projectile loom.

BACKGROUND OF THE INVENTION

In a projectile loom, the filling or weft yarns are drawn across the web of the cloth by a shuttle, a flat metal canister with a rounded nose. The shuttle travels across the web at a high velocity, and is stopped in a very short distance. At the end of travel, the shuttle passes into a gap between an upper and lower brake pad, set to engage the oncoming shuttle and stop the motion of the shuttle.

The stopping position of the shuttle is indefinite, due to such variables as thickness, weight, and lubricity of each individual shuttle, and also due to wear on the brake pads. Accordingly, the brakes are intentionally set to stop the shuttle a short distance beyond the predetermined point at which the yarn is automatically released from the shuttle, and the shuttle thereafter is transferred to a conveyor chain for return to the opposite side of the loom.

When the shuttle enters the braking system, the shuttle returner is at rest a short linear distance beyond the area in which the shuttle is stopped by the brakes. The shuttle returner immediately advances to engage the nose of the braked shuttle and push the shuttle back to the exact position for releasing the filler yarn to the selvage tucking system. The shuttle is subsequently transferred to the conveyor chain for return to the opposite side of the loom.

In actual operation of a projectile loom, the shuttles often overrun the braking system and strike the shuttle returner so that both the nose of the shuttle and the receiving surface of the returner become battered to the point that either or both components must eventually be replaced. This replacement of the shuttle returner is costly not only in the material and labor expense for replacement, but also in the downtime incurred while the loom is withdrawn from operatin to replace the broken shuttles or shuttle returner.

Prior art efforts to alleviate the cost of repair and down time associated with damaged shuttles and shuttle returners usually have involved making those parts more durable, or refining the shuttle braking system to stop the entering shuttle with greater accuracy and reliability. Both approaches to improving the lifetime of shuttles and shuttle returners have, at best, produced marginal gains in the lifetime of the parts involved. Another approach to solving the problem is shown in U.S. Pat. No. 4,415,010 to Schmitz, which proposes an elastically yielding and damping body disposed to absorb impact forces. This latter proposal has not been adopted in commercial practice, however, and does not appear as a significant answer to the problem confronted by the art.

SUMMARY OF INVENTION

Stated in general terms, the shuttle returner apparatus of the present invention has a relatively hard and inelastic shuttle receiving member, and a relatively elastic body firmly attached to the receiving member and connected to the reciprocating arm on the loom that cyclically advances and withdraws the shuttle returner. Because the mass of the shuttle receiving member is quite low, the impact force of an arriving shuttle is mostly transferred into the elastic body member and absorbed in the body member. The elastic body member allows a brief deceleration period for the shuttle receiving member and the impacting shuttle, significantly reducing the relatively abrupt impact encountered with the shuttle returners of the prior art.

Stated somewhat more specifically, the shuttle receiving member and the body member abut each other on a plane substantially perpendicular to the path of the arriving shuttle. Substantially all the impact imparted to the shuttle receiving member by an arriving shuttle thus is transferred to the relatively resilient body member through the perpendicular abutting plane, permitting the resilient body member to absorb substantially all the impact of the arriving shuttle. This impact is converted to heat in the resilient body member and dissipated to the surrounding air.

The shuttle receiving member and the resilient body member preferably each have mutually facing surfaces substantially transverse to the direction of shuttle travel. The shuttle member and body member are interconnected to maintain those facing surfaces in mutually abutting contact, so that the impact of a shuttle striking the shuttle receiving member is transferred into the resilient body member through the abutting surfaces. The interconnection between the shuttle receiving member and the body member can permit quick and easy disassembly of those parts, when replacement or renewal is indicated. A preferred interconnection includes a number of pins extending through mating holes in overlapping portions of the shuttle receiving member and the resilient body member, as little or no impact force is transmitted through the interconnecting members themselves.

Accordingly, it is an object of the present invention to provide an improved shuttle returner.

It is another object of the present invention to provide a shuttle returner of improved durability.

It is a further object of the present invention to provide a shuttle returner which dissipates the impact of an arriving shuttle and thereby reduces the peak force of the impact.

It is another object of the present inventio to simplify the replacement of shuttle returner parts, particularly the shuttle receiving member, when such replacement is necessary.

The foregoing and other objects and advantages of the present invention become more readily apparent from the following detailed description of preferred embodiments.

DESCRIPTION OF PREFERRED EMBODIMENTS

Figures 1, 2, 3, 4, 5:
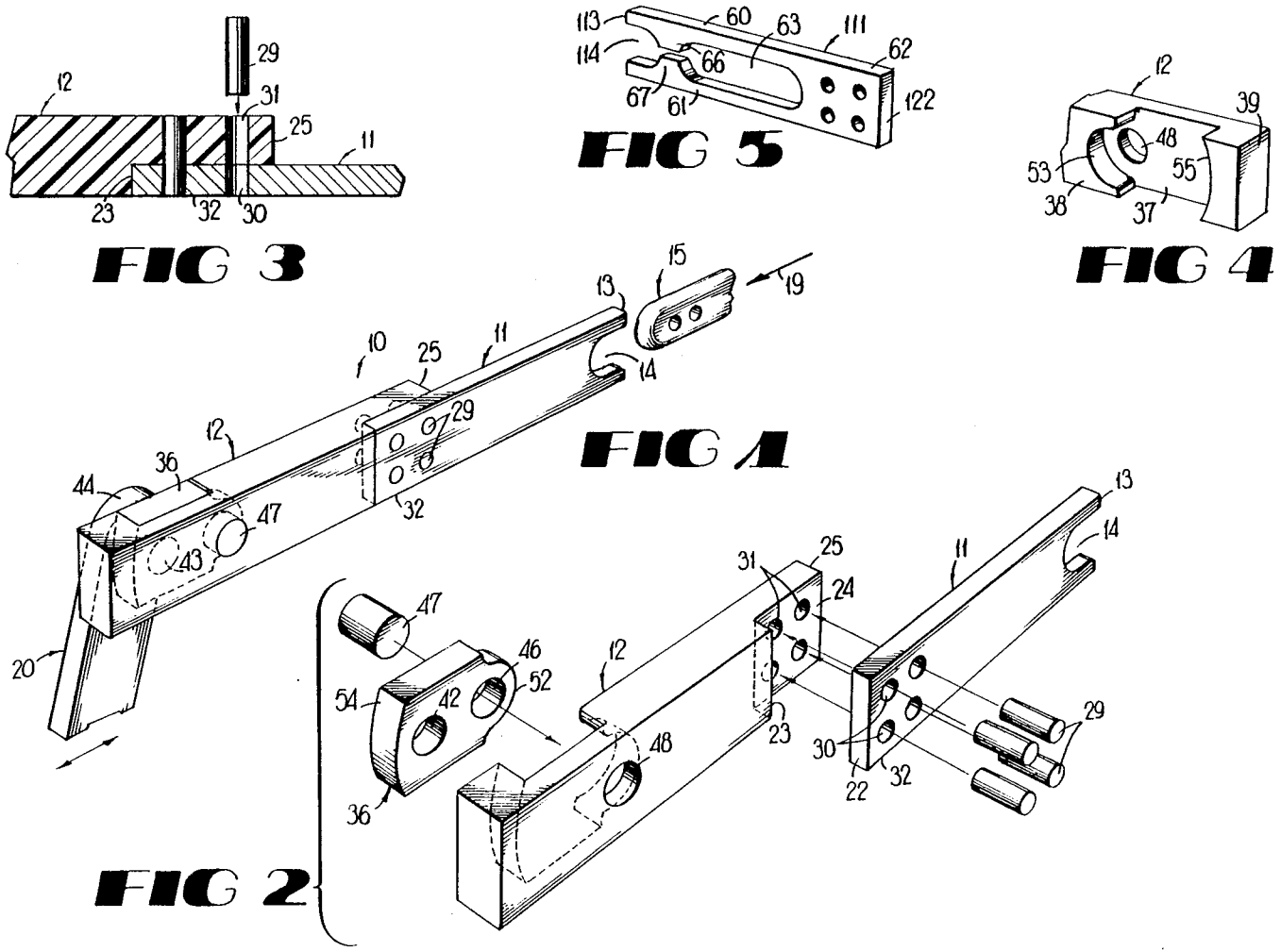
FIG. 1 is a pictorial view showing a shuttle returner according to a preferred embodiment of the present invention.
FIG. 2 is an exploded view of the shuttle returner shown in FIG. 1.
FIG. 3 is a fragmentary section view showing the interconnection of elements in the embodiment of FIGS. 1 and 2.
FIG. 4 is a fragmentary pictorial view showing the connectinglink recess in the resilient body member of the embodiment in FIGS. 1–3.
FIG. 5 is a pictorial view showing an alternative embodiment of the shuttle receiving member according to the present invention.

Turning first to FIG. 1, there is shown generally at 10 a shuttle returner including a receiving member 11 connected to a body member 12. Both the receiving member 11 and the body 12 are elongated members rectangular in overall cross-section, with the thickness of the receiving member being somewhat less than half the thickness of the body in the disclosed embodiment.

Formed in the front end 13 of the receiving member 11 is a U-shaped concavity 14 defining a receiving surface for impact by the rounded nose of a typical shuttle 15. The shuttle 15 arrives on a predetermined path of travel, indicated by the arrow 19, determined by the construction and operation of the projectile loom. The shuttle 15 is only fragmentarily shown in FIG. 1; details of these shuttles and of projectile looms in general are known to those skilled in the art.

The shuttle returner 10 is reciprocated along a predetermined path by cyclical movement of the arm 20 forming part of the loom itself. Those skilled in the art will understand that the typical loom includes structure defining a supporting guideway for the conventional shuttle returner which the present shuttle returner 10 replaces. This supporting structure is omitted for clarity of illustration. Also not shown herein, but understood to exist in projectile looms, is the shuttle braking system mentioned above.

The receiving member 11 is made of a relatively hard material such as steel or the like. This hardness is necessary to withstand the repeated impact of shuttles 15 striking the receiving surface 14. The receiving member 11 thus is relatively inelastic, and transfers the impact of arriving shuttles 15 to the body member 12 with relatively little attenuation of that impact taking place within the receiving member itself. In certain applications, a relatively hard plastic or plastic composite may be used for the receiving member, thereby reducing the stress of repeated metal-to-metal impacts as the shuttles strike the receiving member.

The body member 12, in contrast to the receiving member 11, is relatively elastic, and absorbs (that is, converts to heat) most of the impact transferred into the elastic body member by the receiving member. The body member 12 is fabricated from a medium-hard elastomer sufficiently elastic to absorb the impact of the shuttle with fracturing or plastic deformation, and suitably resistant to wear from the cyclical reciprocating motion undergone by the shuttle returner. The body member 12 is made of a medium-hard polyurethane, in a specific embodiment of the invention.

A good transfer of impact from the relatively inelastic receiving member 11 to the elastic body 12 is an important aspect of the present shuttle returner. This good transfer of impact is accomplished in the disclosed embodiment by maintaining a close abutting contact between the surface 22 (FIG. 2) at the back end of the receiving member 11, and the complementary abutting surface 23 of the body member 12. The abutting surface 22 on the receiving member 11 is at the opposite end from the shuttle receiving surface 14. The abutting surface 22 preferably is perpendicular to the travel path 19 of arriving shuttles, and the abutting surface thus is perpendicular to the direction of force transmitted through the receiving member 11.

The complementary abutting surface 23 on the relatively elastic body member 12 defines the inner end of an L-shaped recess 24 beginning at the front end 25 of the body member and extending a short distance along the length of the body member. As best seen in FIG. 3, the abutting surface 23 is perpendicular to the longitudinal axis of the body member 12, and thus provides a flush abutting engagement with the end surface 22 of the receiving member 11. The length and width of the abutting surface 23 on the body member 12 preferably are at least as large as the corresponding dimensions of the end surface 22 on the receiving member 11, thereby obtaining the greatest possible use of the cross-section area of the receiving member for transferring impact to the body member.

The receiving member 11 and body member 12 are interconnected by the four dowel pins 29. These dowel pins 29 extend through the holes 30 laterally extending through the thickness of the receiving member 11 near the back end 32 of that member, and the mating holes 31 transversely extending through the thickness of the body member 12, at the body member portion defining the L-shaped recess 24 adjacent the front end 25 of the body member. Each dowel pin 29 preferably is no longer than the combined lengths of the corresponding holes 31 and 32, as best seen in FIG. 3. The dowel pins 29 preferably are a push-fit within the aligned holes 30 and 31, so that the dowel pins are readily removable for replacing either the receiving member 11 or the body member 12. The dowel pins are held in place within the shuttle returner 10 by the surrounding structure (not shown) of the loom itself.

Because the impact of arriving shuttles 15 is transmitted from the receiving member 11 to the body member 12 through abutting contact of the end surfaces 22 and 23, the dowel pins and the surrounding surfaces defining the holes 30 and 31 transmit relatively little of this impact force. The primary function of the dowel pins is to hold the receiving member 11 and body member 12 in assembly to form the shuttle returner 10, as the shuttle returner reciprocates in response to movement of the reciprocating arm 20. The constructionn of the present shuttle returner thus permits the use of interconnecting members such as the pins 29 and holes 30, 31, instead of requiring secured fasteners such as rivets or adhesive bonding, inasmuch as these interconnecting members are not subjected to significant shear or impact force from the arriving shuttles 15.

The body member 12 is connected to the reciprocating arm 20 by the connecting link 36, best seen in FIG. 2. This connecting link fits in the recess 37, FIG. 4, formed in the side 38 of the body member 12 adjacent the back end 39 of the body member. The recess 37 and the previously-described L-shaped recess 24 are on opposite sides of the body member 12, allowing the connecting link 36 to fit within the recess 37 and interconnect with the reciprocating arm 20 without modification of the existing reciprocating arm of the loom where the shuttle returner 10 is used.

A first opening 42 is formed in the connecting link 36 and receives the pin 43 (FIG. 1) extending laterally from the end 44 of the reciprocating arm 20. A second opening 46 is formed in the connecting link 36, longitudinally spaced apart from the first opening 42. A dowel pin 47 extends through the second opening 46 and into the coaxial opening 48 extending laterally through the body member 12 near the forward end of the recess 37. The pin 43 in the first opening 42 of the connecting link, and the dowel pin 47 extending through the second opening 46 and the aligned opening 48 in the body member 12, thus interconnect the shuttle returner 10 with the reciprocating arm 20. The pin 47 optionally can be secured in the second opening 46 of the converting link 36, for example by a threaded connection.

The forward end 52 of the connecting link 36 defines a radial surface along the thickness of the connecting link. This forward end 52 abuts the complementary radial surface 53 at the forward end of the recess 37 in the body member 12. The back end 54 also defines a radial surface complementary to the confronting radial surface 55 at the back end of the recess 37. The confronting radial surfaces 52, 53 and 54, 55 allow the connecting link 36 a degree of pivoting movement with respect to the body member 12, necessary because the pin 43 at the end of the reciprocating arm 20 moves along an arc while the shuttle returner 10 is constrained for linear movement along a straight line.

It should be understood that the forward end surface 52 of the connecting link 36 closely abuts the surface 53 at the forward end of the recess 37. This abutting contact of the surfaces 52 and 53 holds the shuttle returner 10 in predetermined position while an arriving shuttle 15 strikes the shuttle returner. The impact of the arriving shuttles, to the extent not absorbed by the resilient body member 12, is thus transferred from the shuttle returner 10 to the reciprocating arm 20 by way of the confronting surfaces 52, 53, the connecting link 36, and the pin 43 on the reciprocating arm.

The operation of the embodiment shown in FIGS. 1–4 should appear from the foregoing description of that embodiment. As an oncoming shuttle 15 strikes the shuttle returner 10, the impact of the shuttle is transmitted from the receiving member 11 to the relatively elastic body member 12 through the abutting surfaces 22 and 23 of the relatively inelastic receiving member and the body member 12. Relatively little, if any, of this impact is transferred through the dowel pins 29, as those dowel pins only link together the receiving member and the body member for reciprocating travel. Most of the impact force of the arriving shuttle 15 is thus transferred into the elastic body member 12 and absorbed therein; the elasticity of the body member gains a short but significant deceleration period for the arriving shuttle 15, and this deceleration period reduces the peak force of the impact on the receiving surface 14 of the receiving member and on the rounded nose of the shuttles 15. This reduction in the peak force of impact, in turn, reduces wear both on the receiving surface 14 and on the rounded nose of the shuttles 15, thereby significantly increasing the useful lifetimes of the shuttle returner 10 and the shuttles 15 themselves.

FIG. 5 shows an alternative embodiment of shuttle receiving member 111 useful with the shuttle returner 10 of the present invention. The shuttle returner 111 is connected to the body member 12 in place of the receiving member 11 previously described with reference to FIGS. 1 and 4, and likewise functions for transferring to the body member the impact of shuttles 15 striking the concave receiving surface 114 of the alternative receiving member. The receiving member 111 is shaped somewhat like a tuning fork, having two prongs 60 and 61 extending forwardly cantilever-fashion from the back portion 62 of the receiving member. The prongs 60 and 61 define an open throat 63 in the interior of the receiving member 111, extending forwardly from the back portion of the member.

In response to the impact of an arriving shuttle 15 striking the curved receiving surface 114 on each receiving member 111, the prongs 60 and 61 momentarily spread apart slightly, absorbing part of the impact as well as allowing a greater deceleration time to reduce the peak force of the impact. Using the alternative receiving member embodiment 111 in combination with the body member 12, the impact of an arriving shuttle is thus absorbed by the slight spreading action of the prongs 60 and 61, and by absorption in the relatively resilient body member 12.

The receiving member 111 has a pair of mutually-facing lands 66 and 67 formed on the insides of the prongs 60 and 61 immediately behind the concave receiving surface 114. These lands 66 and 67 constrict the opening into the throat 63, and prevent a particularly hard-arriving shuttle 15 from forcing its way into the throat.

It should be understood that the foregoing relates only to preferred embodiments of the present invention and that numerous changes and modifications may be made therein without departing from the spirit and scope of the invention as defined by the following claims.

I claim:

1. Shuttle returner apparatus, comprising:

a shuttle receiving member having a receiving surface for impact by a projectile shuttle traveling in a predetermined path;

a body member abutting said shuttle receiving member on a plane perpendicular to said predetermined path, and detachably connected to the shuttle receiving member;

said body member being elastomeric so as to absorb the abrupt impact imparted by the shuttle receiving member when struck by a projectile shuttle;

the shuttle receiving member having a first joining surface substantially transverse to the direction of shuttle travel;

the elastomeric body member having a second joining surface substantially transverse to the direction of shuttle travel and confronting said first joining surface;

the elastomeric body member having a portion extending longitudinally beyond the second joining surface to overlap and lie alongside part of the longitudinal extent of the shuttle receiving member; and connecting means detachably interconnecting said shuttle receiving member and the longitudinally extending portion of said elastomeric body member to maintain said first and second joining surfaces in mutually abutting contact, so that substantially all the impact of a shuttle striking the shuttle receiving member is transferred to the elastomeric body member through the transverse abutting surfaces, and relatively little of the impact is transmitted through the connecting means to the longitudinally extending portion.

2. The shuttle returner as in claim 1, wherein said connecting means comprises:

at least one pair of coaxially aligned holes disposed in the shuttle receiving member and in the longitudinally extending portion of the elastomeric body member;

said pair of holes being axially transverse to the direction of shuttle travel; and dowel means displaceably extending through said coaxially aligned holes to interconnect the shuttle returner and the elastomeric body member and maintain said mutually abutting and impact-transferring contact.

3. Shuttle returner apparatus for use in a projectile loom having an arm that cyclically advances and withdraws the returner apparatus along a path longitudinally in line with the shuttle of the loom, comprising:

a substantially inelastic shuttle receiving member including a receiving surface for receiving the impact of a shuttle traveling in a predetermined direction;

said shuttle receiving member having an impact transfer surface perpendicular to said predetermined direction and spaced apart from said receiving surface;

a relatively elastic body member having a first end operatively associated with the arm for advancement and withdrawal, and having a second end connected to said substantially inelastic shuttle receiving member;

the second end having an impact surface perpendicular to said predetermined direction and in abutting engagement with the impact transfer surface of the shuttle receiving member, for good impact transfer from the shuttle receiving member to the relatively elastic body member;

a portion of the body member extending beyond said impact surface and alongside a portion of the shuttle receiving member;

a plurality of holes formed in said portion of the body member and also formed coaxially in the alongside portion of the shuttle receiving member; and a dowel extending through each hole to detachably link together the shuttle receiving member and body member in said abutting engagement of the impact and impact transfer surfaces, so that substantially all the impact of a shuttle striking the shuttle receiving member is transferred to the elastomeric body through the abutting engagement of the perpendicular impact and impact transfer surfaces, and relatively little of the impact is transmitted through the dowels to said portion of the body member.

4. Shuttle returner apparatus comprising:

a relatively nonresilient shuttle receiving member having a receiving surface for impact by a projectile shuttle arriving on a predetermined path;

a relatively resilient body member detachably attached to said shuttle receiving member;

said body member and shuttle receiving member having respective joining surfaces mutually abutting each other substantially transverse to said predetermined path so that substantially all the impact transferred to the shuttle receiving member by an arriving shuttle is transferred to the relatively resilient body member through said abutting transverse joining surfaces; and means detachably attaching the shuttle receiving member to the body member to maintain said joining surfaces in mutual abutment so that relatively little of the impact is transmitted through said attaching means to the relatively resilient member.

whereby the relatively resilient body member absorbs substantially all the impact transferred to the shuttle receiving member.

5. Apparatus as in claim 4, wherein said shuttle receiving member comprises a back end portion adjoining said resilient body member, and a pair of elongated members connected to said back end portion and extending to terminate at said shuttle receiving surface; and said elongated members being spaced apart from each other cantilever-fashion and having curved surfaces at the shuttle receiving end, whereby the impact of a shuttle striking the shuttle receiving end momentarily spreads apart the elongated members, absorbing some of the impact and allowing a greater deceleration time for the shuttle and thereby reducing said impact transferred to the relatively resilient body member.

* * * * *